US008220089B1

(12) United States Patent
Diefenbach

(10) Patent No.: US 8,220,089 B1
(45) Date of Patent: Jul. 17, 2012

(54) INFANT COMFORT SLEEPER

(76) Inventor: Jeffrey Diefenbach, Alburtis, PA (US)

( * ) Notice: Subject to any disclaimer, the term of this patent is extended or adjusted under 35 U.S.C. 154(b) by 286 days.

(21) Appl. No.: 12/313,109

(22) Filed: Nov. 17, 2008

Related U.S. Application Data

(60) Provisional application No. 61/003,186, filed on Nov. 16, 2007.

(51) Int. Cl.
*A47C 16/00* (2006.01)

(52) U.S. Cl. ..... 5/655; 5/713; 600/27

(58) Field of Classification Search ..... 5/655, 655.3, 5/713, 603, 643, 644, 93.1, 101, 108, 109; 600/22, 26–28; 601/55, 56
See application file for complete search history.

(56) References Cited

U.S. PATENT DOCUMENTS

| | | | | |
|---|---|---|---|---|
| 3,392,723 | A * | 7/1968 | Calvin | 601/5 |
| 3,419,923 | A * | 1/1969 | Cowan | 5/655 |
| 3,803,646 | A | 4/1974 | Newerowski | |
| 4,066,072 | A * | 1/1978 | Cummins | 601/15 |
| 4,088,124 | A * | 5/1978 | Korner et al. | 600/22 |
| 4,133,305 | A * | 1/1979 | Steuer | 601/55 |
| 4,186,457 | A * | 2/1980 | Amelung | 5/680 |
| 4,606,328 | A * | 8/1986 | Thoman | 600/27 |
| 4,730,604 | A * | 3/1988 | Boggs | 601/55 |
| 4,947,500 | A * | 8/1990 | Seiler | 5/713 |
| 5,477,866 | A * | 12/1995 | Davenport | 5/648 |
| 5,561,876 | A | 10/1996 | Petruzella | |
| 5,937,465 | A | 8/1999 | Carew et al. | |
| 6,026,525 | A | 2/2000 | Davis | |
| 6,199,234 | B1 | 3/2001 | Srour et al. | |
| 6,263,526 | B1 * | 7/2001 | Tu | 5/109 |
| 6,912,743 | B1 * | 7/2005 | Weil | 5/93.1 |
| 7,059,000 | B2 | 6/2006 | Verbovszky | |
| 7,475,441 | B1 * | 1/2009 | Soberal | 5/655 |
| 2002/0133877 | A1 * | 9/2002 | Kuiper et al. | 5/81.1 R |
| 2008/0022935 | A1 * | 1/2008 | Fine | 119/28.5 |

* cited by examiner

*Primary Examiner* — Robert G Santos
*Assistant Examiner* — Nicholas Polito
(74) *Attorney, Agent, or Firm* — Montgomery Patent & Design, LLC; Robert C. Montgomery; Joseph T. Yaksich

(57) ABSTRACT

A sleeper apparatus for holding an infant designed to simulate the feeling of being held in a caregiver's arms is herein disclosed. The sleeper is similar in shape to that of a canoe and is able to accommodate most infants via a removable insert section. The insert may be added or removed, depending on the size of the infant. The sleeper is made using padded foam materials and comprises an air bladder located along an inside wall of a perimeter enclosure. The bladder is connected to a DC-powered air pump, which pumps air in and out of the bladder to simulate human breathing. The inner space of the sleeper is contoured to conform to the babies shape. The head area is larger with minimal padding to provide for unobstructed and clear breathing. The foot area is slightly declined and would be provided with additional padding. The sleeper provides a comforting and secure resting place for infants.

16 Claims, 5 Drawing Sheets

INFANT COMFORT SLEEPER

RELATED APPLICATIONS

The present invention was first described in and claims the benefit of U.S. Provisional Patent Application No. 61/003,186 filed on Nov. 16, 2007, the entire disclosures of which are incorporated herein by reference.

FIELD OF THE INVENTION

The present invention relates generally to an infant comfort sleeper and, more particularly, to an apparatus that simulated a mother's breathing motion with an air compressor and an air bladder regulated by a venting valve that provides a gentle motion thereto an infant bed to provide a comfortable resting and sleeping place for said infant.

BACKGROUND OF THE INVENTION

Babies and infants frequently have trouble falling to sleep. This forces caregivers to employ many different strategies to assist a baby to sleep. Many caregivers will place a baby in a car and drive until the child goes to sleep. Others will hold a baby and rock them until they fall asleep. Babies appear to enjoy the feeling of security of being held. The slight feeling of confinement coupled with the rise and fall of the parent's chest as they breathe, is something that is guaranteed to put any baby to sleep. Accordingly, there is a need for a means by which infants can be provided a feeling of comfort and security while parents or care providers attend to other duties. The development of the invention herein described fulfills this need.

There have been attempts in the past to invent sleepers for babies. U.S. Pat. No. 7,059,000 issued to Verbovszky discloses a portable infant cushion that appears to comprise a cushion that encircles an infant. Unfortunately, this patent does not appear to disclose an infant sleeper that comprises a powered air compressor that activates a bladder contained inside of the sleeper that provides the sleeper with the ability to simulate the breathing motions of a care giver.

U.S. Pat. No. 6,912,743 issued to Weil discloses a bed device that appears to comprise a mattress that is conformed to a baby. Unfortunately, this patent does not disclose an infant sleeper that possesses the ability to simulate the breathing motion of a caregiver, nor does it appear to comprise an insertable insert for use with newborns.

U.S. Pat. No. 6,199,234 issued to Srour et al. discloses an infant comfort mattress that appears to comprise a surface designed to reduce surface contact with an infant. Unfortunately, this patent does not disclose an infant sleeper that comprises a base unit with the ability to simulate the breathing motion of a caregiver, nor does it appear to provide an oval shaped enclosure for placing a baby therein.

U.S. Pat. No. 6,026,525 issued to Davis discloses a foldable infant mattress system with sleeping area recess. Unfortunately, this patent does not appear to disclose an infant sleeper that simulates the breathing motion of a caregiver.

U.S. Pat. No. 5,937,465 issued to Carew et al. discloses an infant mattress system with sleeping recess that appears to comprise a mattress made of different materials. Unfortunately, this patent does not appear to disclose a secure and comfortable infant sleeper that possesses the ability to simulate the rise and fall of a caregiver's chest during breathing.

U.S. Pat. No. 5,561,876 issued to Petruzulla discloses an infant mattress comprised of a variety of materials and possessing a bumper area around the perimeter of the bed. Unfortunately, this patent does not appear to disclose an infant sleeper with a removable insert, nor does it appear to disclose an infant sleeper that simulates the breathing motion of a caregiver.

U.S. Pat. No. 3,803,646 issued to Neweroski discloses a mattress for a crib with an integral bumper. Unfortunately, this patent does not appear to disclose an infant sleeper that may be placed on any firm stable surface nor does it appear to be capable of simulating the chest motion of a caregiver during breathing.

SUMMARY OF THE INVENTION

In light of the disadvantages as previously described in the prior art, it is apparent that there is a need for an infant comfort sleeper which provides a "canoe" shaped infant bed comprising an internal oscillating air bladder to simulate a mother's breathing motion.

An object of the infant sleeper is to provide a location to place an infant that is secure and comforts an infant by providing a motion that simulates the rise and fall of the chest of a caregiver through breathing.

Another object of the infant sleeper is to simulate this motion through the use of an air compressor and an air bladder contained within a base unit.

Still another object of the infant sleeper comprises components that are made of hypoallergenic substances and polyurethane foam rubber portions providing waterproof and washable outer surfaces.

Still a further object of the infant sleeper comprises a foam insert that may be placed within the base enclosure to provide for newborns.

Yet another object of the infant sleeper provides an insert that comprises an elevated head area which provides providing for unobstructed and clear breathing to a newborn contained therein.

An aspect of the infant sleeper comprises a base unit, a base bladder, an air compressor, a pneumatic control module, batteries, and an AC power cord.

Another aspect of the infant sleeper comprises a base unit further comprising an insert, a battery compartment, an air compressor, an ON/OFF switch, a rheostatic control knob, and a pneumatic control module. The base unit comprises a plastic open-topped enclosure forming a generally oval-shape enclosure suitable for cradling a baby.

A further aspect of the infant sleeper comprises a base unit comprising an insert that may be removably and snuggly placed when utilizing the apparatus with a newborn infant.

Still another aspect of the infant sleeper comprises a base comprising a base wall that supports a base bladder affixed on the inward facing surface of the base wall. The base bladder comprises an air compressor unit, a solenoid vent valve, and a control module and provides an oscillating breathing motion via an inflating/deflating system.

Still a further aspect of the infant sleeper comprises an air compressor unit that provides an internal air filling means to the base bladder. The air compressor unit is a compact unit and further comprises an integral pneumatic control module, a rheostatic control knob, and an on/off switch being mounted to along a front surface of the base unit.

Yet another aspect of the infant sleeper comprises a pneumatic control module comprises an electronic control device providing a housing means thereto all necessary electrical and pneumatic components required to provide cyclic inflating and deflating of the base bladder via a solenoid vent valve.

Yet a further aspect of the infant sleeper is an external rheostatic control knob that provides manual frequency regulation of said oscillating inflating and deflating of said base bladder.

Yet another aspect of the infant sleeper is a plurality of batteries and an AC adapter to provide power to the sleeper. The batteries are housed in a battery compartment which further comprises a removable plastic flush-mounted access door.

A method of installing and utilizing the apparatus may be achieved by performing the following steps: installing a fresh set of rechargeable or disposable batteries into the battery compartment or, alternately, utilizing the AC adapter using an available household outlet; placing the apparatus preferably thereupon a non-traffic floor area or other safe flat surface; adding appropriate blankets and sheets required to obtain a desired sleeping temperature for an infant; pressing the ON/OFF switch to initiate the air compressor unit and solenoid vent valve, thereby producing the simulated breathing motion; regulating the frequency of said breathing motion by turning the rheostatic control knob to a desired oscillating rate; allowing continuous automatic functioning of the apparatus as needed; pressing the ON/OFF switch again to stop the breathing motion; retaining the infant in the apparatus or removing said infant from the apparatus as desired; and, benefiting from improved quality and duration of a baby or infant's sleeping experience using the present invention.

An alternate method of utilizing the apparatus using the insert portion may be accomplished by performing the following additional steps: placing the insert completely down into the base unit if the apparatus is being used with a newborn baby; placing a baby thereinto said insert giving care to position said baby's head at the proper end of the padded insert floor.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

Figure 1:
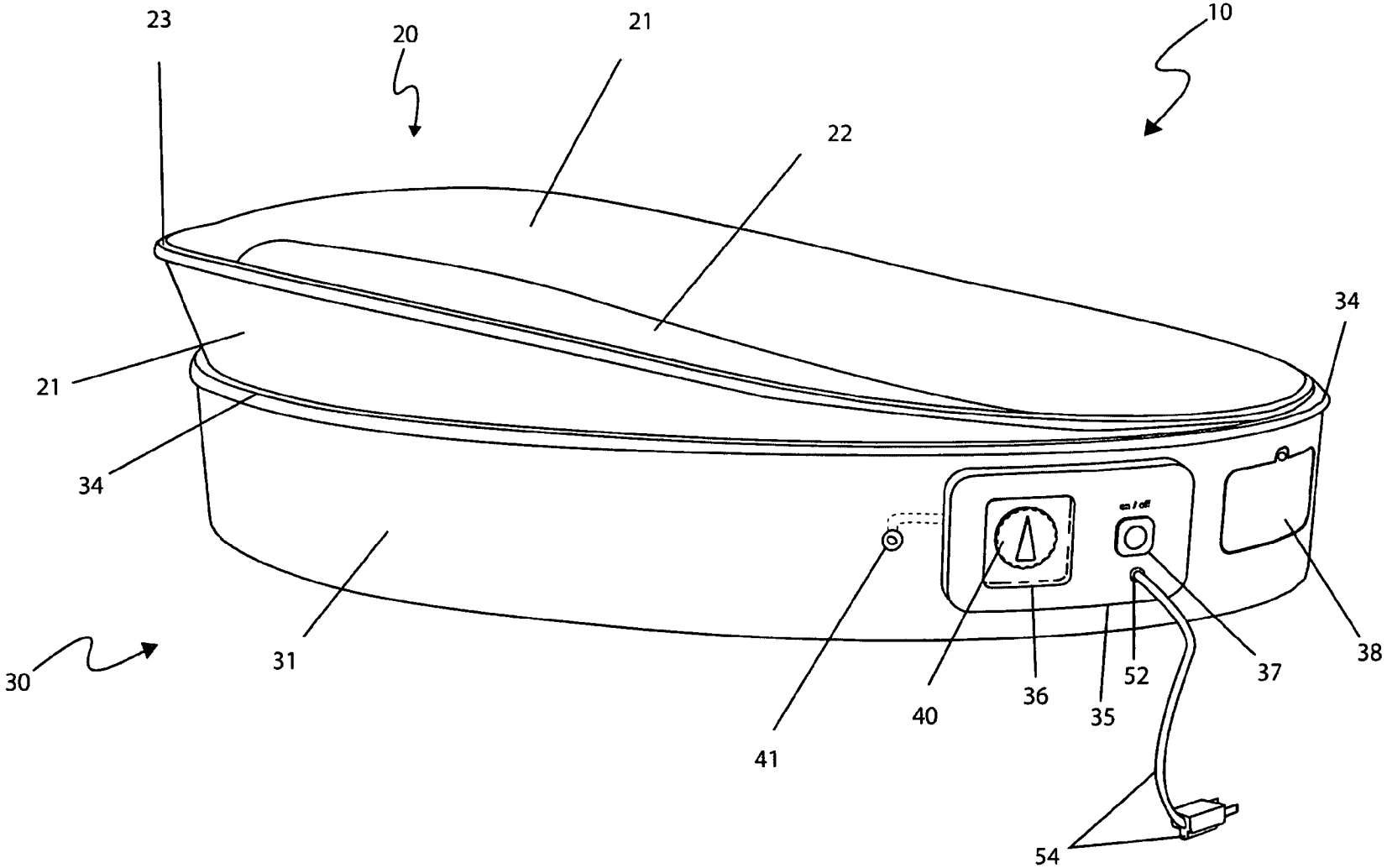
FIG. 1 is a front perspective view of an infant comfort sleeper 10, according to a preferred embodiment of the present invention.

| DESCRIPTIVE KEY | |
|---|---|
| 10 | infant comfort sleeper |
| 20 | insert |
| 21 | insert side panel |
| 22 | insert floor |
| 23 | insert rim |

-continued

| DESCRIPTIVE KEY | |
|---|---|
| 30 | base unit |
| 31 | base wall |
| 32 | base bladder |
| 33 | base floor |
| 34 | base rim |
| 35 | air compressor unit |
| 36 | pneumatic control module |
| 37 | ON/OFF switch |
| 38 | battery compartment |
| 39 | breathing motion |
| 40 | rheostatic control knob |
| 41 | solenoid vent valve |
| 50 | battery |
| 52 | direct current (DC) receptacle |
| 54 | alternating current (AC) adapter |

DETAILED DESCRIPTION OF THE PREFERRED EMBODIMENT

The best mode for carrying out the invention is presented in terms of its preferred embodiment, herein depicted within FIGS. 1 through 4. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an infant comfort sleeper (herein described as the "apparatus") 10, which provides a "canoe" shaped infant bed comprising an internal oscillating air bladder 32 to simulate a mother's breathing motion 39. The apparatus 10 provides an open-topped base enclosure 30 with plastic walls 31. The air bladder 32 is connected to a battery-powered air compressor 35 which pumps air in and out of the bladder 32 to simulate human breathing. The inside of the apparatus 10 is contoured to a baby's shape. Additionally, a foam insert 20 is provided for newborn babies. The use of the apparatus 10 provides a location to place an infant, which is comforting and secure.

Referring now to FIG. 1, a front perspective view of the apparatus 10, according to the preferred embodiment of the present invention, is disclosed. The apparatus 10 comprises a base unit 30, an insert 20, a battery compartment 38, an air compressor 35, an ON/OFF switch 37, a rheostatic control knob 40, and a pneumatic control module 36. The base unit 30 comprises a semi-rigid plastic exterior base wall portion 31 having an open top region providing a generally oval-shaped enclosure being suitable for cradling a baby weighing approximately ten (10) to twenty (20) pounds. Affixed along a front outside surface of said base unit 30 is an air compressor unit 35 further comprising an ON/OFF switch 37, a rheostatic control knob 40, a battery compartment 38, and a pneumatic control module 36. The aforementioned components provide an automatic inflating and deflating means thereto an internal bladder 32, thereby emulating a mother's breathing motion 39 (see FIG. 3). Said air compressor unit 35 and associated controls are powered by a plurality of rechargeable or disposable batteries 50 contained therewithin a battery compartment 38 or receive power therefrom a removably attachable AC adapter 54 subsequently connected thereto a common household 110-volt AC circuit in an expected manner (see FIG. 4). The base unit 30 forms an inner oval-shaped cavity in which an insert 20 may be removably and snuggly placed therein when utilizing the apparatus 10 thereto a newborn infant. The insert 20 comprises a particular size and contour being designed to safely secure a newborn infant (see FIG. 2).

Figure 2:
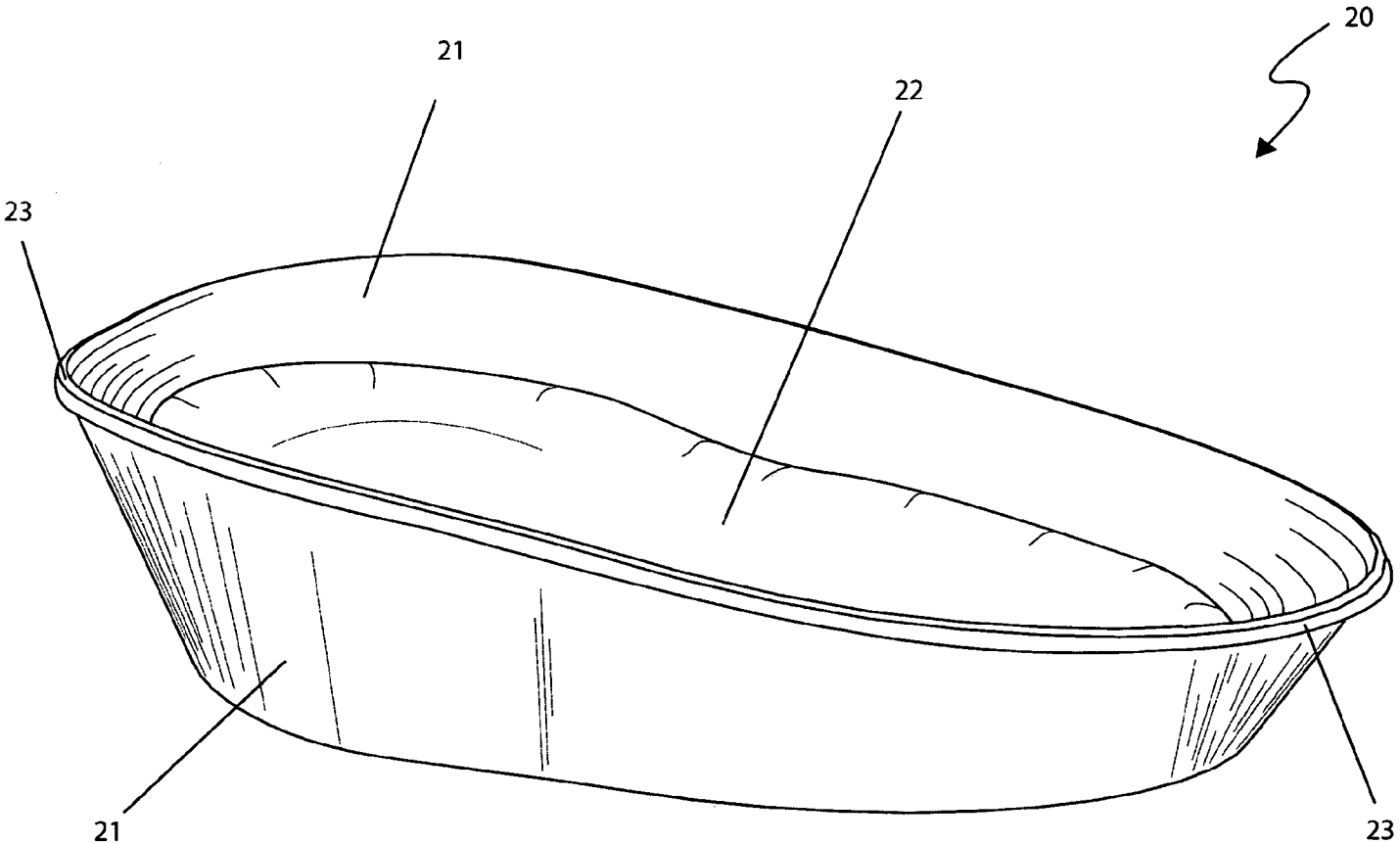
FIG. 2 is a front perspective view of an insert portion 20 of an infant comfort sleeper 10, according to a preferred embodiment of the present invention.

Referring now to FIG. 2, a front perspective view of an insert portion 20 of the apparatus 10, according to the preferred embodiment of the present invention, is disclosed. The insert 20 comprises an insert side panel 21, an insert floor 22, and an insert rim 23. The insert 20 comprises an assembly of molded foam sections of particular sizes and contours designed to gently cradle and secure a newborn infant. The insert 20 and its components are envisioned to be made using hypoallergenic polyurethane foam rubber portions providing waterproof and washable outer surfaces being common in the industry and attached thereto each other using various FDA approved non-toxic adhesives. The insert side panel 21 comprises a perimeter section which forms a generally vertical and continuous surface around the insert 20 being angled outwardly along an upper edge region forming an insert rim 23. The external shape of the insert side panel 21 further comprise contours which correspond in a parallel manner thereto corresponding inner surfaces of the base unit 30, thereby fitting snuggly thereinto said base unit 30. The inside surfaces of the insert side panel 21 slope downwardly and are affixed thereto a horizontal insert floor portion 22. The insert floor 22 comprises a generally oval shape comprising ample padding, thereby providing a comfortable and safe sleeping surface for a baby. The insert floor 22 further comprises an elevated head area which provides a wide surface comprising a reduced padding area to contact an infant's head and facial areas, thereby providing for unobstructed and clear breathing. The insert floor 22 then slopes slightly downward to form a lower and narrower foot area with additional padding. Positioned along a top perimeter edge of the insert 12 is a padded insert rim 23 which provides a protective and decorative border to the insert 12.

Figure 3A:
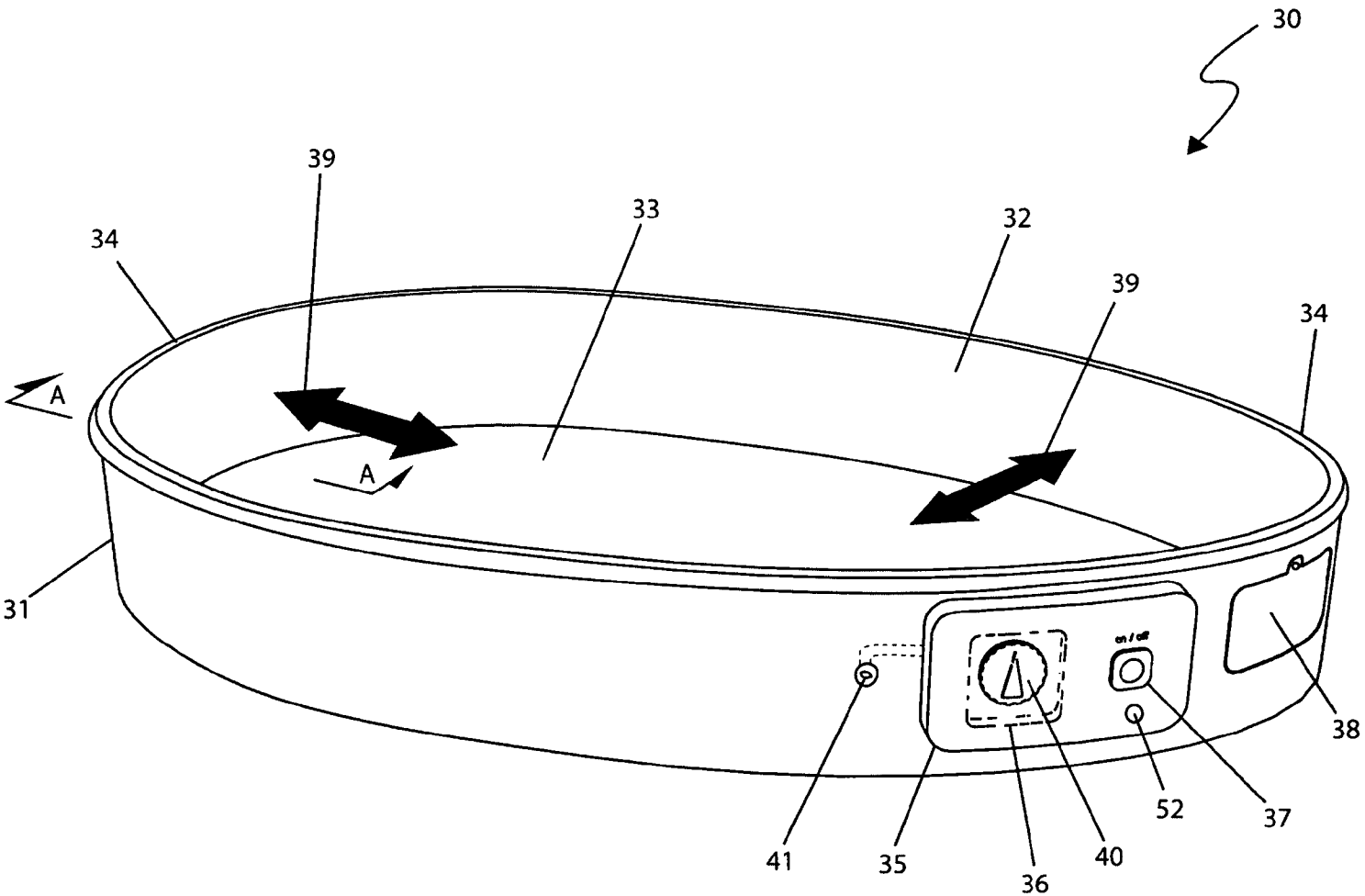
FIG. 3*a* is a front perspective view of a base portion 30 of an infant comfort sleeper 10, according to a preferred embodiment of the present invention.
Figure 3B:
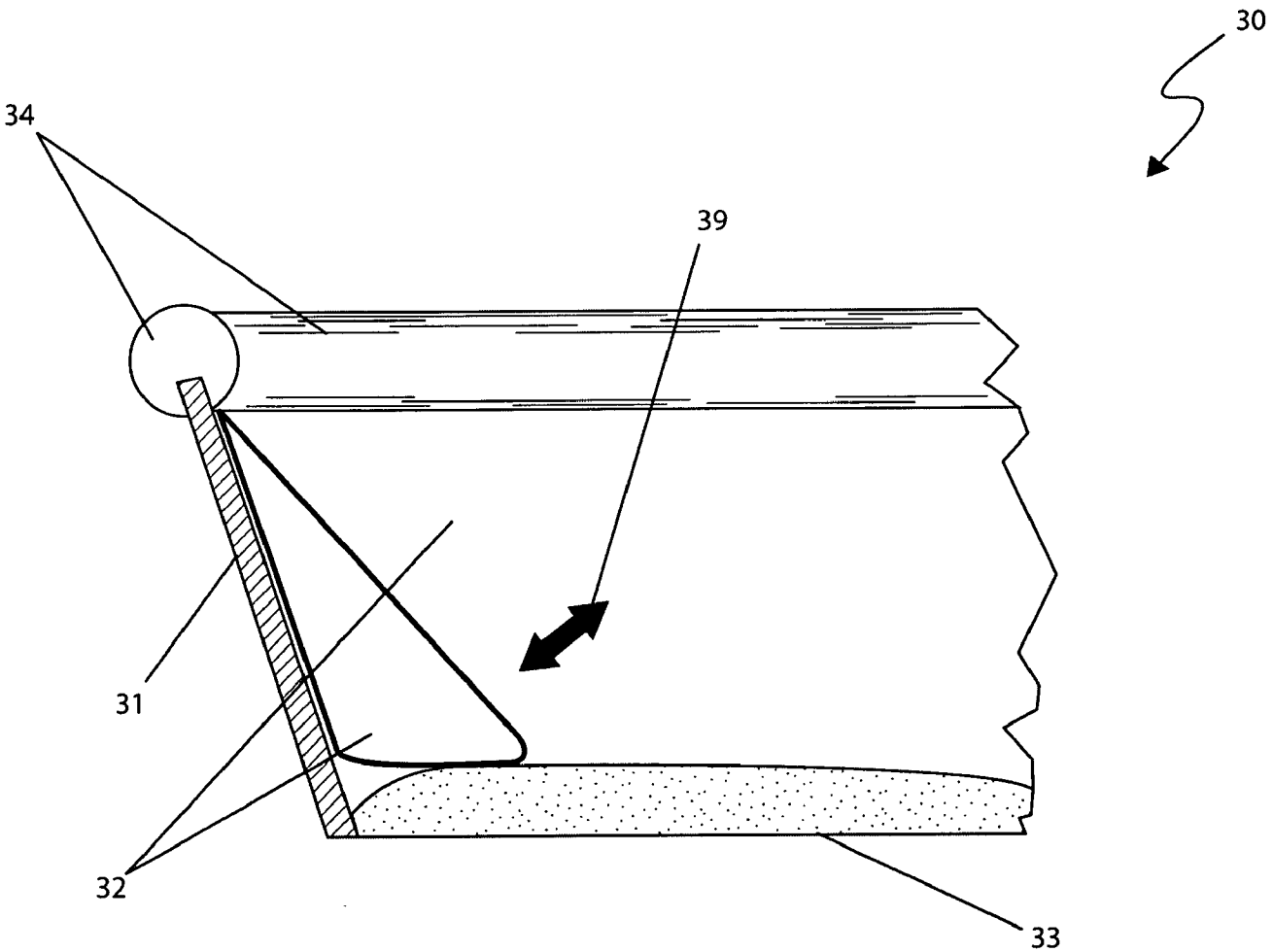
FIG. 3*b* is a section view taken along section A-A (see FIG. 3*a*) of an infant comfort sleeper 10, according to a preferred embodiment of the present invention; and, FIG. 4 is an electrical block diagram of an infant comfort sleeper 10, according to a preferred embodiment of the present invention.

Referring now to FIGS. 3*a* and 3*b*, a front perspective and a section view of a base portion 30 of the apparatus 10, according to the preferred embodiment of the present invention, are disclosed. The base unit 30 comprises a base wall 31, a base rim 34, a battery compartment 38, an air compressor unit 35, an ON/OFF switch 37, a pneumatic control module 36, and a rheostatic control knob 40. The base unit 30 comprises a plastic open-topped enclosure forming a generally oval-shape enclosure approximately fourteen (14) inches wide and thirty (30) inches long with a vertical base wall 31 being approximately eight (8) inches high all around. The base wall 31 is envisioned being made of a semi-rigid plastic material such as polypropylene, acrylonitrile butadiene styrene (ABS), or the like, thereby supporting a base bladder 32 affixed all around an inward facing surface thereof. Affixed therealong a bottom edge portion of the base wall 31 is a base floor 33. The base floor 33 comprises a padded surface to comfortably support an infant without impeding normal breathing. Located along an upper edge of said base wall 31 is a base rim 34. The base rim 34 comprises a rounded edge region affixed thereto the base wall 31 using common adhesives and providing a protective and decorative padded border to the base unit 30 while supporting the insert rim portion 23 of the insert 20 when being utilized. The base wall 31 and base rim 34 are envisioned to be made using dense hypoallergenic polyurethane foam rubber sections providing waterproof and washable outer surfaces being common in the industry and assembled using various FDA approved non-toxic adhesives. The base unit 30 is envisioned being provided in a variety of decorative colors and patterns. The base bladder 32 provides an oscillating breathing motion 39 via an inflating/deflating system comprising an air compressor unit 35, a solenoid vent valve 41, and a control module 36. During an inflating and deflating cycle, the base bladder 32 provides a gentle horizontally expanding and contracting breathing motion 39 directed toward a center point of the base unit 30, thereby emulating a mother's breathing. Additionally, said breathing motion 39 is mechanically transmitted thereinto the insert portion 20 when utilized. The bladder 32 comprises an annular-shaped sealed vessel envisioned to be made of a soft and compliant grade of hypoallergenic latex rubber or equivalent expandable material. The base bladder 32 is affixed along an outer surface thereof to the base wall 31 using FDA approved non-toxic adhesives. Located therebetween the front surface of the base wall 31 and the base bladder 32, in an anticipated foot area, is a compact air compressor unit 35 comprising outwardly facing control components including an ON/OFF switch 37 and a rheostatic control knob 40. The air compressor unit 35 provides an internal air filling means to the base bladder 32. The air compressor unit 35 is envisioned to be a compact unit similar to those used to inflate popular inflatable air mattresses. The air compressor unit 35 also comprises an integral pneumatic control module 36, a rheostatic control knob 40, and an on/off switch 37 being mounted thereto along a front surface of the base unit 30. The pneumatic control module 36 comprises an electronic control device providing a housing means thereto all necessary electrical and pneumatic components required to provide cyclic inflating and deflating of the base bladder 32 via a solenoid vent valve 41 (see FIG. 4). The external rheostatic control knob 40 provides manual frequency regulation of said oscillating inflating and deflating of said base bladder 32, thereby selectively simulating a mother's breathing pattern. The ON/OFF switch 37 initiates a flow of DC electrical power to the air compressor unit 35, and the rheostatic control knob 40. Said DC power is provided via a plurality of batteries 50 or an AC adapter 54 being inserted thereinto a common DC receptacle 52 mounted thereto the air compressor unit 35 along a front surface (see FIG. 4). The battery compartment 38 comprises expected features including a plastic flush-mounted access door which may be easily removed using a small tool to access said batteries 50.

Figure 4:
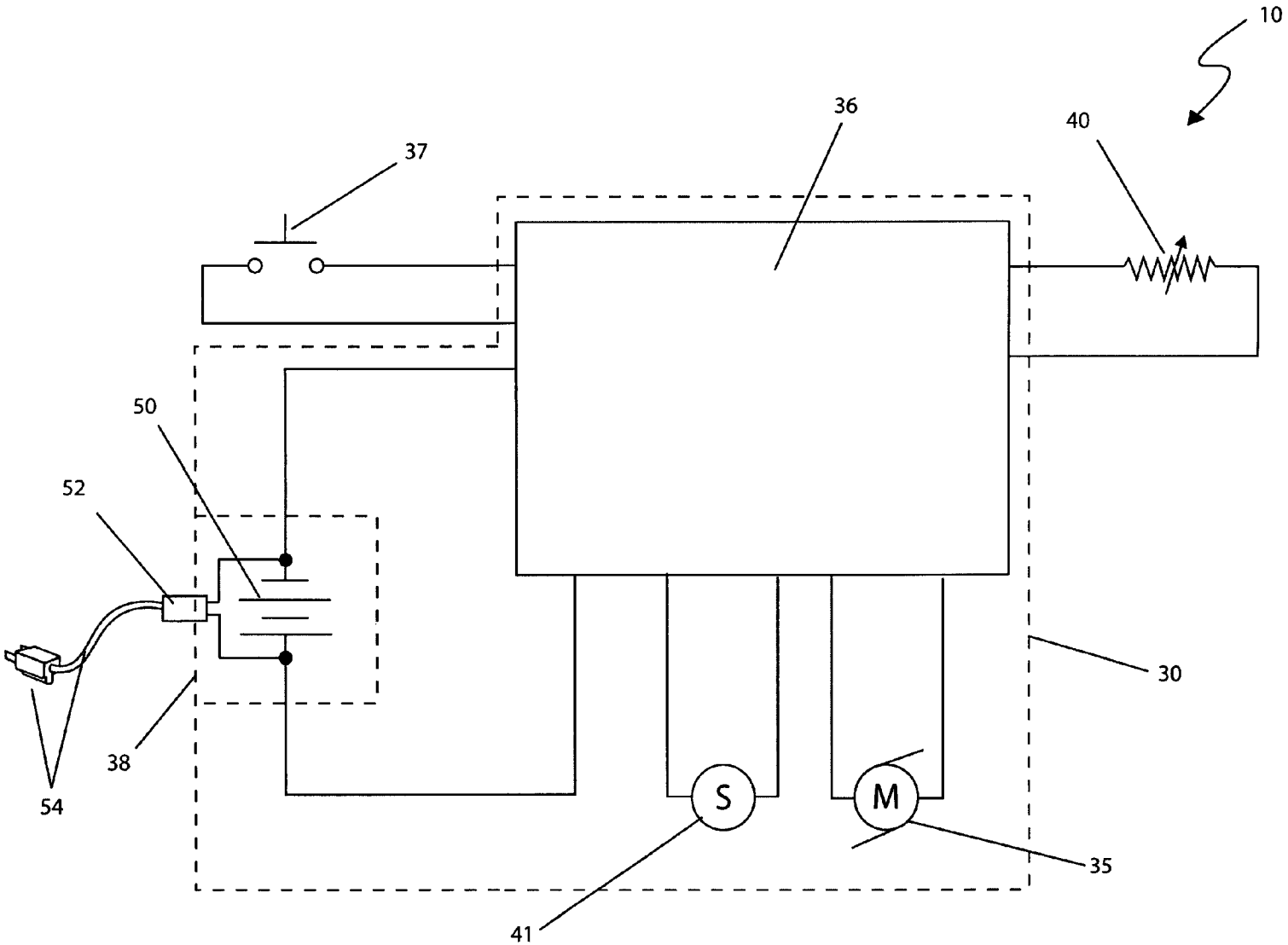

Referring now to FIG. 4, an electrical block diagram of the apparatus 10, according to the preferred embodiment of the present invention, is disclosed. DC power is supplied to the apparatus 10 via a plurality of batteries 50 or therefrom the AC adapter 54 which is subsequently connected thereto a common household 110-volt AC circuit. Said DC power is then conducted thereto a pneumatic control module 36. The pneumatic control module 36 comprises a circuit board which provides input/output capability and embedded software to energize the compressor motor 35 and activate the solenoid vent valve 41 in an alternating fashion, thereby creating an oscillating pneumatic cycle. An ON/OFF switch 37 provides an input signal to said pneumatic control module 36 to initiate said continuous cycles until said ON/OFF switch 37 is pressed again. The ON/OFF switch 37 is envisioned to be a simple panel-mount momentary contact closure device common in the industry. The pneumatic control module 36 also provides a means to control a frequency of said oscillating pneumatic cycle via a rheostatic control knob 40 which provides a variable voltage input thereto said pneumatic control module 36. The pneumatic control module 36 subsequently provides an output current thereto the motor portion of the air compressor unit 35 and thereto the solenoid vent valve 41 during operation of the apparatus 10.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1.

The method of installing and utilizing the apparatus 10 may be achieved by performing the following steps: installing a fresh set of rechargeable or disposable batteries 50 thereinto the battery compartment 38 or, alternately, utilizing the AC adapter 54 using an available household outlet; placing the apparatus 10 preferably thereupon a non-traffic floor area or other safe flat surface; adding appropriate blankets and sheets required to obtain a desired sleeping temperature for an infant; pressing the ON/OFF switch 37 to initiate the air compressor unit 35 and solenoid vent valve 41, thereby producing the simulated breathing motion 39; regulating the frequency of said breathing motion 39 by turning the rheostatic control knob 40 thereto a desired oscillating rate; allowing continuous automatic functioning of the apparatus 10 as needed; pressing the ON/OFF switch 37 again to stop the breathing motion 39; retaining the infant therein the apparatus 10 or removing said infant therefrom the apparatus 10 as desired; and, benefiting from improved quality and duration of a baby or infant's sleeping experience using the present invention 10.

An alternate method of utilizing the apparatus 10 using the insert portion 20 may be accomplished by performing the following additional steps: placing the insert 20 completely down into the base unit 30 if the apparatus 10 is being used with a newborn baby; placing a baby thereinto said insert 20 giving care to position said baby's head at the proper end of the padded insert floor 22.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An infant comfort support apparatus, comprising:

an infant bed, comprising an open-topped base unit, further comprising:

a semi-rigid base wall having an open top region a head area and a foot area, thereby providing a generally oval-shaped enclosure;

a base floor affixed along a bottom edge of said base wall; and, a base rim located along an upper edge of said base wall, comprising a rounded edge region affixed to said base wall, thereby providing a protective and decorative padded border thereto said base unit;

an insert removably inserted in said base unit and further comprising:

an insert side panel, comprising an assembly of molded sections;

an insert rim comprising a continuous padded surface around an upper perimeter edge of said insert side panel; and, an insert floor affixed to a bottom edge portion of said insert side panel;

an air bladder internal thereto said infant bed, supported by and affixed to said base wall;

an air compressor in fluid communication therewith said air bladder affixed thereto said infant bed; and, a control means in electrical communication therewith said air bladder;

wherein said infant comfort sleeper simulates a mother's breathing motion, thereby providing a comforting resting or sleeping location therefor an infant;

wherein said infant bed remains stationary as said air bladder simulates the mother's breathing motion; and, wherein a gentle horizontally expanding and contracting breathing motion is mechanically transmitted thereinto.

2. The apparatus of claim 1, wherein said base wall comprises a semi-rigid plastic material from one (1) of the following list: polypropylene, or acrylonitrile butadiene styrene (ABS).

3. The apparatus of claim 1, wherein said base floor further comprises a padded surface to comfortably support said infant without impeding normal breathing.

4. The apparatus of claim 1, wherein said base wall and said base rim each comprise a dense hypoallergenic polyurethane foam rubber, thereby providing a waterproof and a washable outer surface.

5. The apparatus of claim 1, wherein said base unit comprises approximately fourteen (14) inches in width, thirty (30) inches in length, and said base wall comprises approximately eight (8) inches in height.

6. The apparatus of claim 1, wherein said air bladder comprises an annular-shaped sealed vessel comprising a soft and compliant grade of expandable material and affixed along an outer surface thereof said base wall;

wherein said air bladder provides said gentle horizontally expanding and contracting breathing motion directed toward a center point of said base unit when receiving a flow of air therefrom said air compressor, thereby simulating said mother's breathing motion.

7. The apparatus of claim 1, wherein said air compressor is located therebetween a front surface of said base wall and said air bladder within said foot area, thereby providing an internal air filling means thereto said air bladder.

8. The apparatus of claim 1, wherein said control means further comprises:

a pneumatic control module in electric communication therewith said air compressor, comprising an electronic control device providing a housing means thereto a solenoid vent valve;

an ON/OFF switch externally mounted thereto said base unit and in electric communication therewith said pneumatic control module and a power source; and, a rheostatic control knob externally mounted thereto said base unit and in electrical communication therewith said pneumatic control module;

wherein said solenoid vent valve provides a venting means required to provide cyclic inflating and deflating of said air bladder, thereby simulating said mother's breathing motion; and, wherein said rheostatic control knob provides manual frequency regulation of said air compressor, thereby selectively simulating a particular pattern of said mother's breathing motion.

9. The apparatus of claim 8, wherein said power source further comprises a DC source removably inserted therein a battery compartment externally located thereon said base unit.

10. The apparatus of claim 8, wherein said power source comprises an AC adapter being inserted thereinto a common DC receptacle externally located thereon said base unit.

11. The sleeper of claim 1, wherein said infant bed further comprises a means to cradle and support said infant weighing approximately ten (10) to twenty (20) pounds.

12. The apparatus of claim 1, wherein said insert side panel comprises an external shape comprising contours enabling said insert to correspondingly mate therewith an inner surface thereof said base unit, thereby enabling said insert to fitting snuggly thereinto said base unit.

13. The apparatus of claim 1, wherein said insert floor comprises a generally oval shape comprising ample padding, thereby providing a comfortable and safe sleeping surface for said infant.

14. The apparatus of claim 1, wherein said insert floor further comprises:

an elevated head area which provides a wide surface comprising a padding area to contact an infant's head and facial areas, thereby providing for unobstructed and clear breathing; and, a lower foot area sloping slightly downward therefrom said elevated head area and further comprising padding.

15. The apparatus of claim 1, wherein said insert comprises a dense hypoallergenic polyurethane foam rubber, thereby providing a waterproof and a washable outer surface.

16. The sleeper of claim 1, wherein said infant bed further comprises a means to cradle and support said infant weighing approximately ten (10) to twenty (20) pounds.

* * * * *